US006597107B1

(12) United States Patent
Mészáros et al.

(10) Patent No.: US 6,597,107 B1
(45) Date of Patent: Jul. 22, 2003

(54) TUNGSTEN-RHENIUM FILAMENT AND METHOD FOR PRODUCING SAME

(75) Inventors: István Mészáros, Budapest (HU); Tamás Gál, Hajdúböszörmény (HU); György Nagy, Budapest (HU); Zita Fábián, Örbottyan (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,510

(22) Filed: Jan. 11, 2002

(51) Int. Cl.[7] ..... H01J 1/62
(52) U.S. Cl. ..... 313/491; 313/633
(58) Field of Search ..... 315/491, 633

(56) References Cited

U.S. PATENT DOCUMENTS 4,413,205 A 11/1983 Ooms
5,072,147 A 12/1991 Pugh et al.
6,066,019 A 5/2000 Bewlay

FOREIGN PATENT DOCUMENTS

GB 1053020 12/1966

*Primary Examiner*—Vip Patel
(74) *Attorney, Agent, or Firm*—Fay, Sharpe, Fagan, Minnich & McKee, LLP

(57) ABSTRACT

A tungsten-rhenium filament is disclosed. The filament has a re-crystallization temperature above 2000° C., and it comprises an aluminum-potassium-silicon (AKS) additive. The potassium content of the filament is between 80–110 ppm, and the rhenium content is between 0.05–0.19% by weight. A method for manufacturing a rhenium-tungsten filament is also disclosed. The method comprises the following steps. An AKS doped tungsten-rhenium alloy powder is prepared with a rhenium content of 0.05–0.19% by weight, and a potassium content between 80–110 ppm. The alloy powder is pressed and presintered, and thereafter sintered with direct current. A rhenium-tungsten filament is formed which has a metastable crystal structure. The filament is wound on a mandrel, and it is annealed on the mandrel below the re-crystallization temperature. The filament is finally re-crystallized above the re-crystallization temperature. A halogen incandescent lamp with an envelope enclosing a tungsten-rhenium filament is also provided.

20 Claims, 5 Drawing Sheets

TUNGSTEN-RHENIUM FILAMENT AND METHOD FOR PRODUCING SAME

BACKGROUND OF INVENTION

The invention relates to a tungsten-rhenium filament with increased re-crystallization temperature. The invention also relates to a method for manufacturing such a rhenium-tungsten filament and a halogen incandescent lamp comprising the tungsten-rhenium filament.

Tungsten filaments for incandescent lamps are well known in the art. In most applications, the filaments are made of a wire which is wound into a coil. Coil dimensions determine not only the achievable light output of the lamp, but also the optical properties of the light beam emerging from the optical projector system of the lamp. Such projector systems are found, among others, in headlights of automobiles. Lamps with small filaments have better optical parameters and allow the formation of a well-defined projected beam, even with small-sized projecting optics.

Therefore, the coils with extremely small external dimensions are being produced for automotive lamps. The small external dimensions means that the inner diameter of the coils are also small, in the order of the wire diameter. The inner diameter of the coil largely corresponds to the diameter of the mandrel on which the filament is wound during manufacturing of the coil. The ratio of the diameter of the mandrel to the wire diameter is termed as the mandrel ratio. In this manner, coils with a small inner diameter will also have a small mandrel ratio. Since the filament wire diameter also has a practical lower limit, filaments with small mandrel ratio are necessary for achieving the best possible light efficiency.

During the filament production, the coiled filaments are annealed (heat treated to preserve the shape of the filament). This annealing serves to enable the assembly of the filaments on an automated mounting machine without breakage. During the annealing of the coil, a part of the coils made of wires with known tungsten-AKS composition tend to re-crystallize at least partly, and mainly on the compressed side of the coil. This partial re-crystallization significantly increases the probability that the coil will break. This leads to the failure of the lamp in a short time. As for these lamps the allowed defect rate is critical for marketability, a high defect rate cannot be tolerated.

In some special light sources, which provide outstanding optical parameters, the required parameters may be obtained only with coils having a very small mandrel ratio, in the order of 2 to 1.5, or even lower. This extreme mandrel ratio may cause a decrease of the re-crystallization temperature of the filament material. The exact physical mechanism of this effect is not known precisely. The decrease of the starting temperature of the re-crystallization process may be as large so that the initial re-crystallization temperature will fall in the temperature range of the annealing treatments used during the coil production. As a result, the re-crystallization process starts too early, already in the annealing phase, and thereby increases the mounting, shipping and installation defects, and thus impairing the production yield and reliability of the lamps. This significant decrease of the re-crystallization temperature may amount to 500 600° C. on the inner parts of the coil which must endure the largest shaping tension or shaping stress.

In order to improve mechanical properties of the filaments, it has been suggested to include small amounts of rhenium in the tungsten. Typically, 1–3% by weight of rhenium is added. For example, UK Patent No. 1,053,020 teaches the addition of rhenium between 0.1–7% by weight, preferably 3% by weight. The improvement of the filament is achieved by promoting the formation of elongated grains in the tungsten, as it undergoes a re-crystallization during the lifetime of the lamp. The problem of decreased re-crystallization temperature is not recognized. The grain formation is also supported by grain shaping additives, as aluminum, potassium and silicon, commonly known as AKS.

Further, U.S. Pat. No. 5,072,147 suggests the use of tungsten filaments that are largely re-crystallized and have a grain structure with elongated interlocking grains. In order to quantify the quality of the grains, it is suggested to use the so-called grain shape parameter which is based partly on the value of the Grain Aspect Ratio (GAR). U.S. Pat. No. 5,072,147 stresses the importance of achieving a large value of the GAR because it is seen as a key factor for the so-called non-sag property of the filament. Again, no mention is made of the lower limit of the re-crystallization temperature.

U.S. Pat. No. 6,066,019 also mentions the use of a tungsten-rhenium filament which is re-crystallized before the lamp is actually used. This is necessary because the filament need to be mechanically supported during the re-crystallization. The re-crystallization temperature is above 2600° C., in a relatively narrow temperature range. The problem of the decreased re-crystallization temperature in the strongly bent parts of the coil is not mentioned. On the contrary, the heat treatment method of the U.S. Pat. No. 6,066,019 inherently presumes a relatively uniform re-crystallization temperature range in the whole filament in which all parts of the filament start re-crystallizing only above a well-defined temperature.

U.S. Pat. No. 4,413,205 also suggests the use of rhenium for improving the properties of tungsten, but not for improving the grain structure or for modifying the re-crystallization temperature of the filament. Instead, the surface of the integral conductors is sought to be improved against the attacks of bromine. The suggested composition contains at least 0.1%, but preferably between 1–3% by weight of rhenium.

While the use of the AKS dopants and the use of rhenium in tungsten is well known for the filaments of incandescent lamps, the use of AKS by itself provides no solution to the problem of decreased re-crystallization temperature. The addition of AKS is mostly used to facilitate the grain forming process. However, with increasing color temperatures being typical for high-power automotive lamps, particularly with filaments that have operating temperatures above 2800° K., an increased tendency of void formation on the grain boundaries is observed. These voids weaken the grain structure and accelerate the filament degrading process. The formation of the voids is attributed to the potassium. The addition of rhenium improves the grain structure of the filament and thereby compensates the negative effect of the potassium, at least partly. It was believed that the addition of at least 1% by weight rhenium is necessary to compensate for the void forming effect in filaments operating at high temperatures.

It was observed that the grain structure and thereby the mechanical properties improve with higher amounts of rhenium, but even small amounts (as little as 1%) increase the temperature necessary for the complete re-crystallization for tungsten filaments above the critical value of 2600–2700° K. With presently available mass production technology, the filaments may be heated up to approx. 2750°

K. during the re-crystallization. Raising the final re-crystallization temperature above this value would significantly increase the cost of the filament manufacturing.

Therefore, there is a need for a tungsten-rhenium filament having an initial re-crystallization temperature above the annealing temperature of the filament, which at the same time has optimum grain structure, and which may be manufactured economically.

SUMMARY OF INVENTION

In an embodiment of a first aspect of the present invention, there is provided a filament made of a tungsten-rhenium alloy wire. The wire has a re-crystallization temperature above 2000° C. The filament wire comprises AKS additive. The wire material has a potassium content between 80–110 ppm, and a rhenium content of 0.05–0.19% by weight.

In an embodiment of a second aspect of the invention, a method for manufacturing the rhenium-tungsten filament wire comprises the following steps. An AKS doped tungsten-rhenium alloy powder is prepared, preferably by blending together AKS doped tungsten powder and rhenium powder. The blended alloy powder has a rhenium content of 0.05–0.19% by weight and a potassium content between 80–110 ppm. The alloy powder is pressed and presintered. Thereafter, the alloy powder is sintered with direct current. A filament wire with a metastable crystal structure is formed of the sintered alloy. The wire is wound on a mandrel, and it is annealed on the mandrel while in the metastable crystal structure, and the annealing is done on a temperature below 2000° C. (approx. 2300° K.). The filament wire is re-crystallization at a temperature above the re-crystallization temperature to achieve a stable crystal structure.

The tungsten wire produced on the basis of the method results in improved filament stability because the re-crystallization of the coiled filament starts at a significantly higher temperature, even with extremely small mandrel ratio.

In another embodiment of a further aspect of the invention, a halogen incandescent lamp comprises an envelope enclosing a tungsten-rhenium filament. The filament comprises an AKS additive. The potassium content of the filament is between 80–110 ppm in the filament, and the filament has a rhenium content of 0.05–0.19% by weight.

BRIEF DESCRIPTION OF DRAWINGS

The invention will now be described with reference to the enclosed drawings, where.

DETAILED DESCRIPTION

Figure 1:
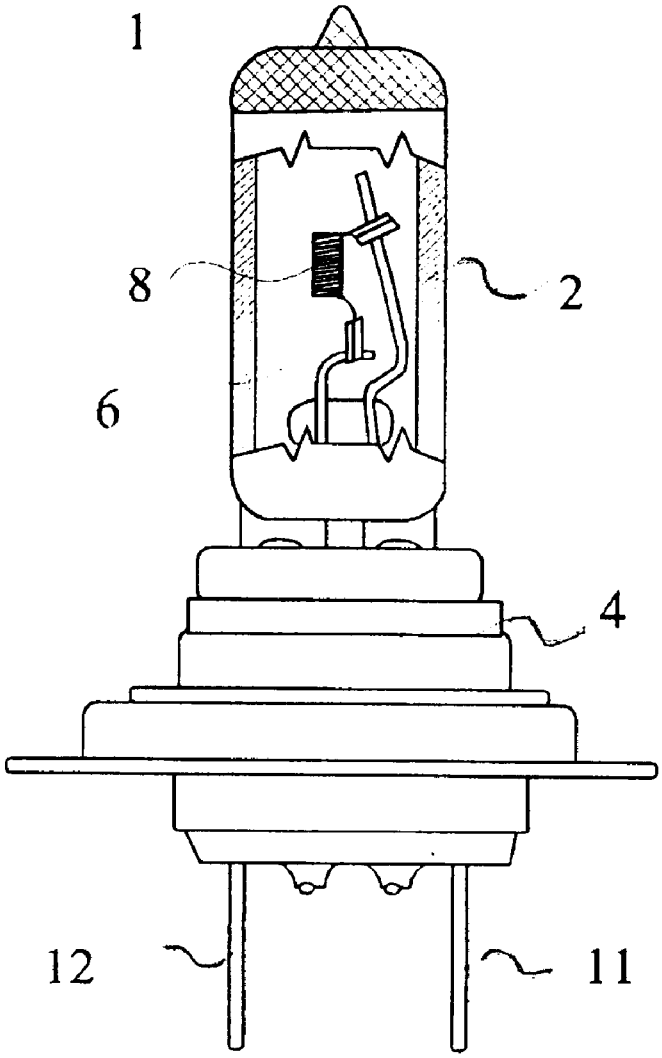
FIG. 1 is a side view of an incandescent automotive lamp.
Figure 2:
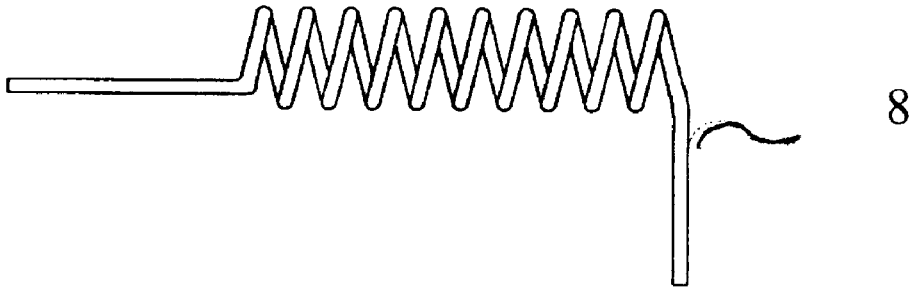
FIG. 2 illustrates the filament of the lamp of FIG. 1.

Referring now to FIGS. 1 and 2, there is shown an automotive lamp 1. The lamp 1 has a sealed lamp envelope 2 typically made of glass. The envelope 2 is supported mechanically by a metal base 4 which also holds the contacts 11, 12 of the lamp 1. The envelope 2 has a sealed inner volume 6 filled with a suitable gas, like argon, krypton or xenon. The inner volume 6 also contains a filament 8. The filament 8 is made of a rhenium-tungsten alloy. In the shown embodiment, the filament 8 is single coiled. However, coiled-coiled filaments are also commonly used, particularly for higher wattage lamps. The filament 8 is designed for an envelope 2 with limited external dimensions which also limits the dimensions of the filament 8. Often, the filament 8 must be also capable of high color temperature operation, i. e. in the switched on state, its operating temperature may be above 2900° K., and in extreme cases it may even reach 3200° K.

The filament contains an aluminum-potassium-silicon (AKS) additive. Thus the potassium content of the tungsten-rhenium alloy of the filament is between 80–110 ppm, while it has a rhenium content of 0.05–0.19% by weight. The preferred composition contains 0.15% by weight of rhenium. The rhenium is distributed uniformly in the volume of the tungsten. This is ensured during the manufacturing of the filament, as will be explained below. The suggested composition of the filament is able to combine the advantages of doping with K, Si, Al, and those of alloying with Re. Surprisingly, it was found that with a rhenium content of as low as 0.05–0.19% by weight, not only a very good grain structure was achieved, but such a filament with the above described composition will have a relatively high initial re-crystallization temperature. With other words, the re-crystallization process of the filament 8 will not start below a certain temperature. With the proposed composition, this initial re-crystallization temperature will be above 2000° C.

Figure 3:
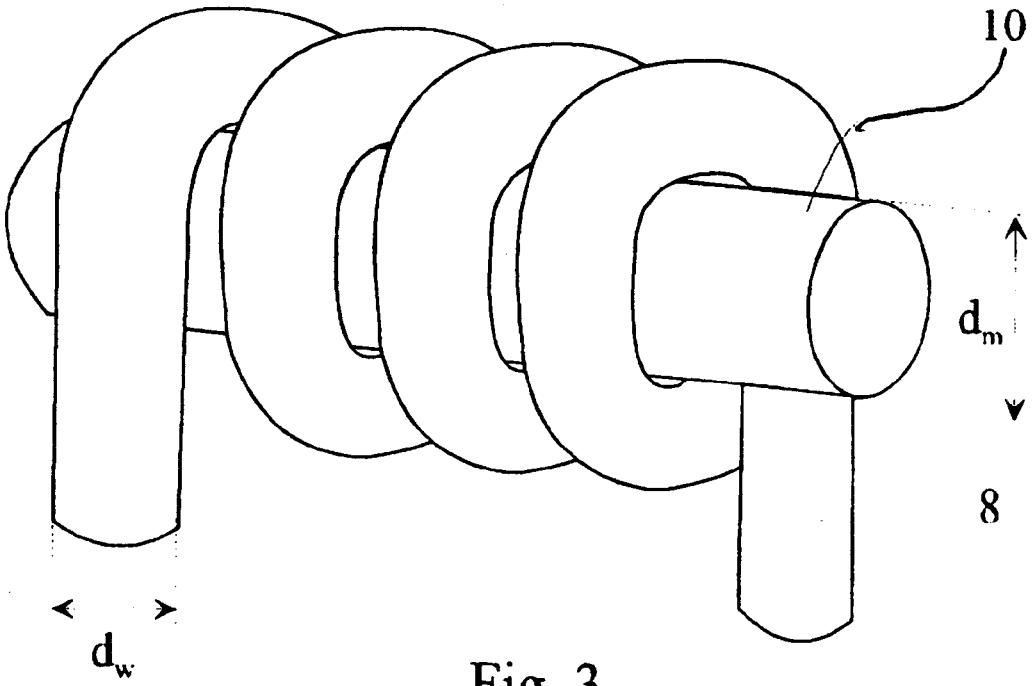
FIG. 3 is an enlarged figure of a filament wound on a mandrel.

Particularly with filaments where the mandrel ratio is extremely small, may be as low as 1.42, the above effect is significant. As mentioned above, the filament coil is formed during manufacturing by winding the wire of the filament 8 on a mandrel 10, as illustrated in FIG. 3. The mandrel ratio is defined as the ratio of the external diameter $d_m$ of the mandrel to the wire thickness $d_w$, i. e. the mandrel ratio is $d_m/d_w$. The mandrel ratio must be low, in order to obtain proper optical parameters. In the filament manufacturing method, the low-temperature coil re-crystallization related to the small mandrel ratio coiling is eliminated or at least partly compensated by setting the potassium content between 80 and 110 ppm, and using 0.05 0.19 weight % rhenium as auxiliary alloying element. With this solution the usual initial re-crystallization temperature of about 1400° C. (1700° K.) of the traditional tungsten coils doped with K, Si and Al will be increased by about 300° K., above 1700° C. (2000° K.) even for thin filament wires in the 0.05 0.4 mm diameter range being in a stressed state. In the non-stressed state, the initial re-crystallization temperature may increase above 2000° C. (2300° K.). The increase of the initial re-crystallization temperature may cause similar increase of the final re-crystallization temperature, but it will still be below the critical value of 2600–2700° K.

In this way, the general mechanical properties of the filaments of special incandescent lamps with small mandrel ratio are maintained, while it is still possible to produce the filaments with standard manufacturing equipment. This means in practice that the production output analogous to the applied traditional K, Si, Al doped tungsten wire may be reached, while providing the same defect rate and filament winding quality.

Figure 4:
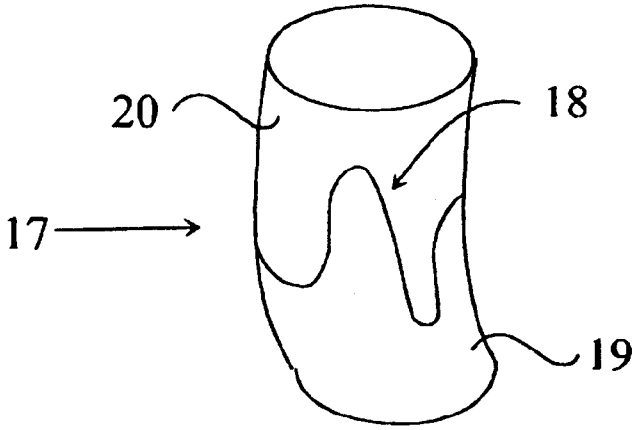
FIG. 4 is a schematic view illustrating the final grain structure of the filament made according to the method.

With the proposed tungsten-rhenium filament, the usual parameters of the filament, like hot tensile strength (HTS) etc. characterizing the interlocking grain structure, will not deteriorate, and also the end of the re-crystallization temperature may remain within the 2400–2500° C. usual in filament production. The low Re content does not affect the cycle time during the manufacturing process of the halogen lamp, which is an important parameter of the mass production. Long process cycles inevitably raise the production costs. The proposed filament also retains its shape at operating temperature. This is commonly referred to as a non-sag property of the filament. The non-sagging of a filament at high temperature is attributed to various wire parameters. An important parameter is the interlocking grain structure of the material of the tungsten filament in its re-crystallized condition. This is quantified by the Grain Aspect Ratio, shortly GAR. The GAR is a measure of the interlocking of the grains, as it is explained in detail in the U.S. Pat. No. 5,072,147. For relatively thick wires, i. e. in the order of 300–400 microns, a GAR of 12 or higher is considered as an acceptable value. For thinner wires, in the order of 50–200 microns, higher GAR values can be achieved, with preferred values above at least 50, or even above 100. With other words, a high GAR value means that the tungsten wire of the filament 8 contains large crystallites and a good interlocking grain structure. This is explained with reference to FIG. 4 which shows a segment 17 of the filament 8 in FIG. 2. The segment 17 contains two grains 19 and 20, with a grain interface 18 between them. It is desired to achieve a large area of the interface 18, which will then ensure good connection between the grains 19 and 20, and therewith the filament 8 will be resistant to sag and better withstands vibration. The development of the interlocking grain structure is facilitated by K, Si, Al doping of the tungsten wire. The amount of this additive is limited. It is foreseen that the filament 8 comprises less than 100 ppm, preferably between 80 and 90 ppm potassium. The aluminum and silicon are used only as a carrier material for the potassium. Therefore, these carrier materials may be limited to less than 10 ppm for the silicon, and to less than 13 ppm for the aluminum.

Figure 5:
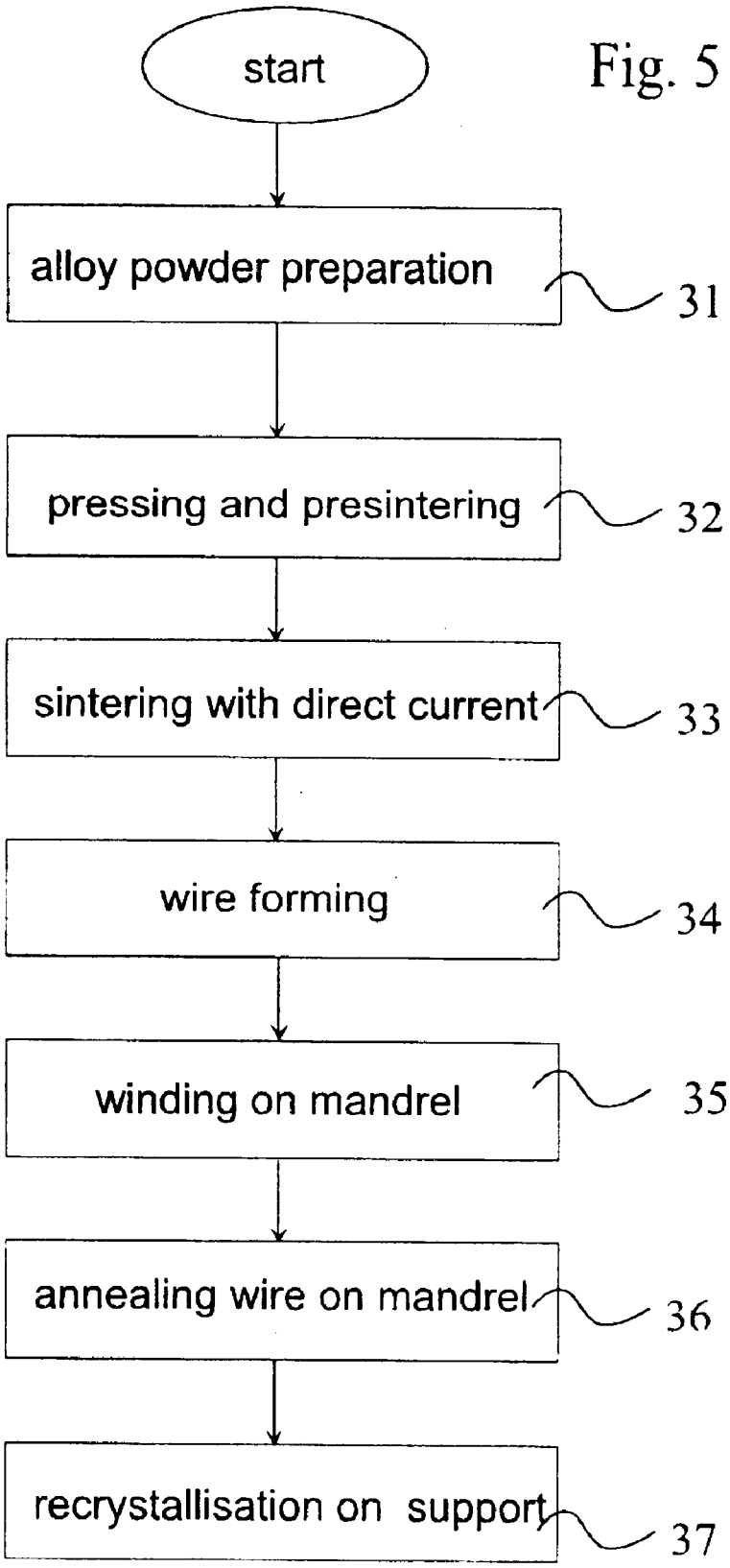
FIG. 5 is a flow chart of the method for manufacturing the filament.

Filaments similar to the filament 8 in FIG. 2 were produced by the following process, as also illustrated by steps 31 to 37 in FIG. 5.

The base material for the filament is AKS doped tungsten-rhenium alloy powder. The process starts with the preparation of the alloy powder, see step 31 in FIG. 5. The alloy has a rhenium content of 0.05–0.19% by weight, and it is distributed evenly in the tungsten with known techniques, e.g. by dry or wet doping, together with the AKS or separately. The doping of the tungsten and the powder preparation is known by itself. Similar processes are described, among others, in U.S. Pat. No. 6,066,019. In the proposed method, the AKS dopant is added to achieve a potassium content between 80–110 ppm.

Following the alloy powder preparation, the alloy powder is pressed and presintered, see step 32. The pressing and presintering is also made in a known manner in order to prepare the alloy powder for the sintering. Thereafter, as shown in step 33, the alloy powder is sintered with direct current. This is a known process step in powder metallurgy. The specific parameters of the sintering, i. e. temperature, atmosphere composition and sintering current are dependent of the geometrical and other parameters of the furnace. Typical values of sintering current are between 3000 and 6000 A, and the sintering is done in a hydrogen atmosphere. The sintering of a tungsten alloy is also disclosed in U.S. Pat. No. 6,066,019. The sintering of the alloy with direct current effectively blocks the later void formation by the potassium on the grain interfaces.

After the sintering, a rhenium-tungsten wire is formed from the sintered alloy ingot, see step 34, and a filament is made from the wire. The forming of a filament is done with known metalworking techniques, e.g. rolling, swaging and wire drawing. The alloy now has a metastable crystal structure, as described among others in GB Patent No. 1,053,020 and U.S. Pat. No. 5,072,147. This state is considered metastable because the filament re-crystallizes at higher temperatures either before actual operation or during operation. For high operating temperature filaments, the re-crystallization must be done before the filament is finally mounted in the lamp. After the re-crystallization, the re-crystallized structure will remain stable even at lower temperatures.

After the wire forming in step 34, the wire is wound on a mandrel in step 35 (see also FIG. 3). Thereafter, the filament is annealed while wound on the mandrel, as illustrated in step 36. The filament is annealed while being in the metastable crystal structure. The annealing is performed at a temperature below the re-crystallization temperature, practically at a temperature between 1500–1900° K. The annealing serves to relieve the stresses built up during the metalworking process. The annealing step is also known in the art per se for tungsten filaments, e.g. from U.S. Pat. No. 5,072,147. The annealing may comprise several heating and cooling cycles.

The tungsten wires doped with AKS with a potassium content between 80–100 ppm in the filament material were also used for the production of single and double coils with extremely small mandrel ratio. It has been found that the interaction of the small quantity of rhenium and the potassium, where the potassium content is above 80 ppm, but below 110 ppm, preferably even below 90 ppm, causes a substantial increase of the temperature at which a coiled wire starts re-crystallizing. This temperature value is termed as the initial re-crystallization temperature. With the proposed tungsten-rhenium composition, the increase of the initial re-crystallization temperature was sufficient to prevent the re-crystallization from starting during the annealing process.

After the annealing process, the filament is re-crystallized at a temperature above the initial re-crystallization temperature, see step 37 in FIG. 5. For filaments with the proposed composition, it will mean temperatures below 2750° K. After the re-crystallization, the filament has a stable crystal structure with practically all grains formed as elongated interlocking grains. The resultant GAR of the grains is not less than 12, but often higher for thinner wires. The re-crystallization is done in furnace, and the filament is disposed on a mechanical support during the re-crystallization in a known manner, e.g. as disclosed in U.S. Pat. No. 6,066,019. Usually, the mechanical support comprises a tungsten boat or a tungsten mandrel.

From the above, it is clear that the proposed method combines the advantages of the K, Si, Al doping and rhenium alloying, so that the initial re-crystallization temperature of the filament is increased in a way to avoid the occurrence of the above described disadvantages. This effect is most significant for incandescent lamp coils with extremely small mandrel ratio, i.e. below 2. The proposed method provides practically the same yield as that of the prior art tungsten wires doped with K, Si and Al. The suggested composition also ensures an essentially crack-free condition of the filament. This composition contains approx. 15–40% more potassium than that of known filaments. In this manner, the initial re-crystallization temperature of the tungsten-rhenium wire and the coil made of the wire may increase as much as 200° C. for the wire, and approximately 200–250° C. for the coil. At the same time, the final re-crystallization temperature remains below the lamp's operating temperature, so there will be no coil breakage and/or coil cracking during the coil production and assembly. Deformation of the coil after the switch-on of the lamp is also largely prevented. The low Re content will not negatively affect the operation of the cyclical process of halogen lamps.

Representative wire and coil characteristics for prior art filaments and filaments with the proposed composition are shown in the table below.

| Filament Type | Start of re-crystallization Ø 0,4 mm wire | End of re-crystallization Ø 0,4 mm wire | Start of coil re-crystallization with 1,5 mandrel ratio |
|---|---|---|---|
| Traditional AKS | 1900–2000° C. | 2200° C. | 1400° C. |
| K content: 85 ppm<br>Re content: 0.13% | 2200° C. | 2500° C. | >1700° C. |

Test tungsten metal samples with 85 ppm potassium content and 0.13 weight % rhenium alloy were produced. From the samples, tungsten wires were made for the coil production. The most important characteristics of the wires were controlled (high temperature strength, cracking level, starting point of re-crystallization temperature, crystal length/diameter ratio, etc.) at a diameter of 0.4 mm in accordance with standard manufacturing procedures. The consistency and adequacy of the results was checked, and the parameters of the wires were compared to the parameters of prior art mass-produced tungsten wire. The parameters also included the initial re-crystallization temperature.

Figure 6:
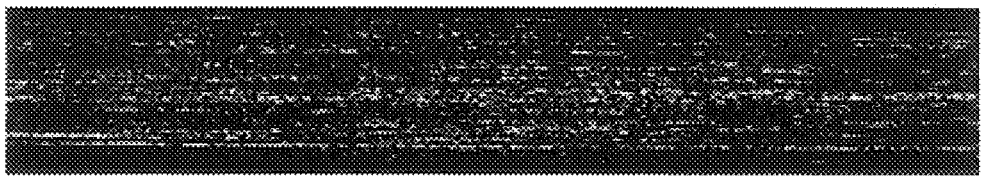
FIG. 6 is a photograph of a prior art tungsten wire before re-crystallization.
Figure 7:
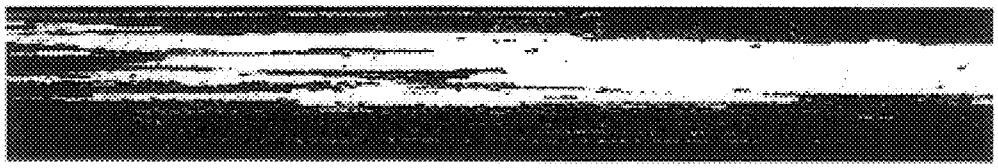
FIG. 7 is a photograph of a prior art tungsten wire with started re-crystallization.
Figure 8:
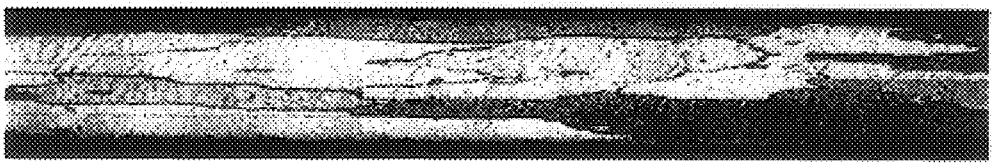
FIG. 8 is a photograph of a prior art tungsten wire after complete re-crystallization.

The starting point of the re-crystallization temperature for the prior art material is 1900–2000° C. (approx. 1600–1700° K.), while it is 2200° C. (approx. 1900° K.) for the wire with the proposed composition. It is also demonstrated with the metallographic cross-sections of the wire samples annealed at increasing temperature and shown in the FIGS. 6 to 8. FIG. 6 illustrates the cross-section of a prior art tungsten wire batch doped with K, Si and Al after a heat treatment at 1900° C. (approx. 1600° K.) for 5 minutes. As seen in FIG. 6, the wire remained fibrous. FIG. 7 shows the same wire after a heat treatment at 2000° C. (approx. 1700° K.) for 5 minutes: the re-crystallization of the wire has started. Finally, FIG. 8 shows the effect of a heat treatment at 3100° C. for 5 minutes. The elongated grain boundaries indicate a high-temperature generated final crystal structure of the wire.

Figure 9:
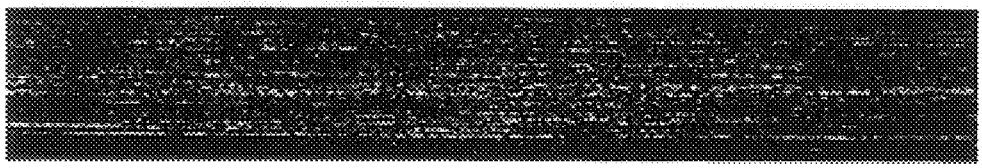
FIG. 9 is a photograph of a tungsten wire produced with the method, before re-crystallization.
Figure 10:
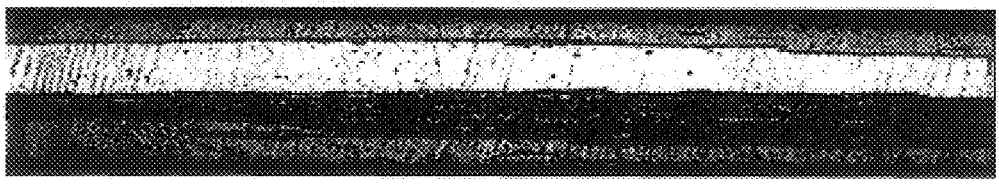
FIG. 10 is a photograph of a tungsten wire produced with the method, where re-crystallization has started.
Figure 11:
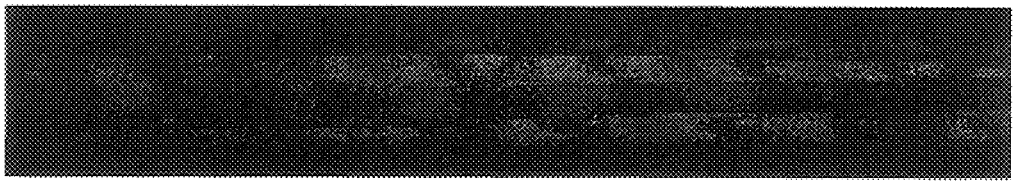
FIG. 11 is a photograph of a tungsten wire produced with the method, after complete re-crystallization.

FIGS. 9 to 11 show the cross-section of a tungsten wire batch doped with K, Si and Al, where the composition also contained 0.13% by weight Re and the K content was 85 ppm. FIG. 9 shows the effect of a heat treatment at 2100° C. for 5 minutes: the wire remained fibrous. FIG. 10 shows the same wire after a heat treatment at 2200° C. for 5 minutes. The appearance of visible grain boundaries indicate that the re-crystallization of the wire has started. Finally, FIG. 11 show the effect of a heat treatment at 3100° C. for 5 minutes. The high-temperature generated final crystal structure of the wire is clearly visible.

Figure 12:
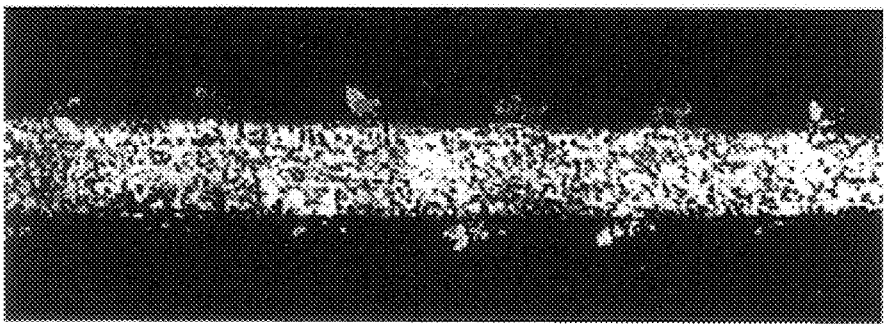
FIG. 12 is a photograph of a cross-section of a prior art tungsten wire wound on a mandrel, after an annealing step and showing signs of early re-crystallization.
Figure 13:
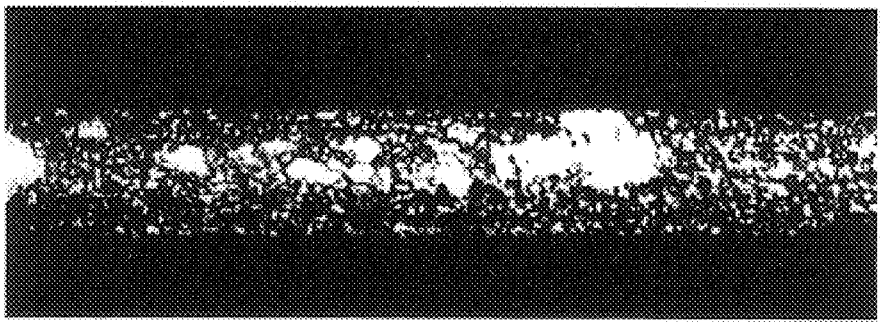
FIG. 13 is a photograph of a cross-section of a tungsten wire produced with the method, after an annealing step, without indication of early re-crystallization.

The effect is even more marked when the wire is wound into a coil, as seen by comparing FIGS. 12 and 13. FIG. 12 shows a photograph of a cross-section of a coil made of a prior art wire batch doped with K, Si and Al. The effect of a heat treatment at 1500° C. for 5 minutes is visible on the photo. The re-crystallization of the coil has started: this is seen by the small white areas in the wire which are adjacent to the larger diameter mandrel. By comparison, FIG. 13 shows the metallographic cross-sections of a wire with the proposed 0.13% Re and 85 ppm K content, after a heat treatment at 1700° C. for 5 minutes. The cross section of the wire itself remained completely dark which indicates that the re-crystallization of the coil has not started.

The photos of FIG. 8 and FIG. 11 of the totally re-crystallized structure of the two wires demonstrate the extremely good overlapping structure of the prior art wire and also that of the wire manufactured with the method. The large overlapping of the grains is essential in ensuring good high temperature strength and long life-time of the filaments.

The proposed type of tungsten wire is applicable for all types of lamps, and it is principally recommended for the production of special lamps with small mandrel ratio double spiral filaments. The application of this wire will largely reduce the breakage of finished lamps during handling and shipping. In addition, the excellent overlapping crystal structure will ensure a long life-time for the lamps produced from this type of wire.

The invention is not limited to the shown and disclosed embodiments, but other elements, improvements and variations are also within the scope of the invention.

What is claimed is:

1. A filament made of a tungsten-rhenium alloy wire, the wire material having a re-crystallization temperature above 2000° C., the wire material comprising an aluminum-potassium-silicon (AKS) additive, the wire material having a potassium content between 80–110 ppm, and having a rhenium content of 0.05–0.19% by weight.

2. The filament of claim 1 in which the rhenium content is 0.09–0.15% by weight.

3. The filament of claim 1 in which the wire material comprises less than 100 ppm potassium.

4. The filament of claim 3 in which the potassium content in the wire material is between 80–90 ppm.

5. The filament of claim 1 in which a mandrel ratio of the filament is less than 2.

6. The filament of claim 1 in which the mandrel ratio of the filament is less than 1.5.

7. The filament of claim 1 in which the rhenium is uniformly distributed in the volume of the tungsten.

8. The filament of claim 1 in which a diameter of the filament wire is between 0.05 and 0.4 mm.

9. The filament of claim 1 in which the wire material comprises less than 10 ppm silicon.

10. The filament of claim 1 in which the wire material comprises less than 13 ppm aluminum.

11. The filament of claim 1 in which the filament is a single coiled or coiled-coiled filament.

12. A method for manufacturing a rhenium-tungsten filament, comprising the following steps:

preparing an AKS doped tungsten-rhenium alloy powder having a rhenium content of 0.05–0.19% by weight, and a potassium content between 80–110 ppm;

pressing and presintering the alloy powder;

sintering the alloy powder with direct current;

forming a rhenium-tungsten filament wire of the sintered alloy with a metastable crystal structure;

winding the wire on a mandrel, annealing the filament wire on the mandrel while in the metastable crystal structure at a temperature below 2000° C., re-crystallizing the filament at a temperature above 2000° C.

13. The method of claim 12 in which the diameter of the filament wire is between 0.05 and 0.4 mm.

14. The method of claim 12 in which the ratio of diameter of the mandrel to the diameter of the filament wire is between 2 and 1.2.

15. The method of claim 12 in which the re-crystallization is made at a temperature not higher than 2450° C.

16. The method of claim 12 in which the re-crystallization is done in furnace, and the filament is disposed on a mechanical support during the re-crystallization.

17. The method of claim 16 in which the mechanical support comprises a tungsten boat or a tungsten mandrel.

18. A halogen incandescent lamp comprising an envelope, the envelope enclosing a filament made of a tungsten-rhenium alloy wire, the filament comprising AKS additive, the potassium content of the wire being between 80–110 ppm, and the wire having a rhenium content of 0.05–0.19% by weight.

19. The lamp of claim 18 in which a diameter of the filament wire is between 0.05 and 0.4 mm.

20. The lamp of claim 18 in which filament is coiled, and the ratio of the inner diameter of the coil to the diameter of the filament wire is between 2 and 1.2

* * * * *